United States Patent [19]

Jongenburger et al.

[11] Patent Number: 4,798,625

[45] Date of Patent: Jan. 17, 1989

[54] SUPERALLOY WITH OXIDE DISPERSION HARDENING HAVING IMPROVED CORROSION RESISTANCE AND BASED ON NICKEL

[75] Inventors: Peter Jongenburger, Baden; Robert Singer, Untersiggenthal, both of Switzerland

[73] Assignee: BBC Brown Boveri AG, Baden, Switzerland

[21] Appl. No.: 90,346

[22] Filed: Aug. 28, 1987

[30] Foreign Application Priority Data

Sep. 8, 1986 [CH] Switzerland ..... 3593/86

[51] Int. Cl.[4] ..... C22C 29/12

[52] U.S. Cl. ..... 75/235; 75/233

[58] Field of Search ..... 75/233, 235

[56] References Cited

U.S. PATENT DOCUMENTS

| | | | |
|---|---|---|---|
| 3,660,049 | 5/1972 | Benjamin | 75/233 |
| 3,728,088 | 4/1973 | Benjamin | 75/233 |
| 3,738,817 | 6/1973 | Benjamin | 75/233 |
| 3,743,548 | 7/1973 | Baranow et al. | 75/233 |
| 3,749,612 | 7/1973 | Benjamin et al. | 75/233 |
| 3,776,704 | 12/1973 | Benjamin | 75/233 |
| 3,809,545 | 5/1974 | Benjamin | 75/233 |
| 3,920,489 | 11/1975 | Buchanan | 75/233 |
| 4,080,204 | 3/1978 | Ponzera | 75/233 |
| 4,599,214 | 7/1986 | Luton | 75/233 |
| 4,631,082 | 12/1986 | Andrews et al. | 75/233 |

*Primary Examiner*—John F. Terapane
*Assistant Examiner*—Eric Jorgensen
*Attorney, Agent, or Firm*—Oblon, Fisher, Spivak, McClelland & Maier

[57] ABSTRACT

Superalloy with oxide dispersion hardening having improved corrosion and oxidation resistance and based on nickel with the following composition:

Cr=17–18% by weight,
Al=6–7% by weight,
Mo=2–2.5% by weight,
W=3–3.5% by weight,
Ta=2–2.5% by weight,
Zr<0.2% by weight,
B<0.02% by weight,
C<0.1% by weight,
$Y_2O_3$=1–1.5% by weight,
Ni=Remainder.

7 Claims, No Drawings

SUPERALLOY WITH OXIDE DISPERSION HARDENING HAVING IMPROVED CORROSION RESISTANCE AND BASED ON NICKEL

TECHNICAL FIELD

Superalloys with oxide dispersion hardening based on nickel which, owing to their outstanding mechanical properties at high temperatures, find application in the construction of heat engines subjected to high thermal and mechanical loads. Preferred application as blade material for gas turbines.

The invention relates to the further development of nickel-based superalloys with oxide dispersion hardening having completely ideal properties in relation to high-temperature strength, long-term stability and resistance to oxidation and corrosion in an aggressive atmosphere.

It relates in particular to a superalloy with oxide dispersion hardening having improved corrosion resistance and based on nickel.

Prior art

The following references are cited in relation to the prior art:

G. H. Gessinger, Powder Metallurgy of Superalloys, Butterworths, London, 1984;

R. F. Singer and E. Arzt, to be published in: Conf. Proc. "High Temperature Materials for Gas Turbines", Liège, Belgium, October 1986, J. S. Benjamin, Metall. Trans., 1970, 1, 2943–2951.

In the course of recent years a new class of high-temperature superalloys, intended in particular as components of heat engines (gas turbine blades) has been developed. These are nickel-based alloys which contain finely divided dispersoids in the form of oxides. Mostly, the latter are $Y_2O_3$ particles. One of the most well-known alloys of this type with oxide dispersion hardening is the nickel-based alloy obtainable from INCO under the trade name MA 6000 which has the following composition:

Cr=15.0% by weight,
Al=4.5% by weight,
Ti=2.5% by weight,
Mo=2.0% by weight,
N=4.0% by weight,
Ta=2.0% by weight,
Zr=0.15% by weight,
8=0.01% by weight,
C=0.05% by weight,
$Y_2O_3$=1.1% by weight,
Ni=Remainder.

(cf. H. F. Merrick, L. R. Curwick and Y. G. Kim, Nasa Report CR-1335150, Contract NAS-3-19694, 1977, Cleveland, Ohio, USA and R. C. Benn, L. R. Curwick and G. A. J. Hack, Powder Met. 1981, No. 4, pages 191–195).

Although said alloy has excellent mechanical properties at high temperatures, in numerous applications it fails to meet the operating requirements in terms of oxidation and sulfidation resistance.

In order to improve the anticorrosion properties, INCO have developed a new alloy. It has the following composition:

Cr=20.0% by weight,
Al=6.0% by weight,
Mo=2.0% by weight,

W=3.5% by weight,
Zr=0.19% by weight,
B=0.01% by weight,
C=0.05% by weight,
$Y_2O_3$=1.1% by weight,
Ni=Remainder.

Although this alloy, which has higher Cr and Al contents than MA 6000, has improved corrosion resistance, as a result of the formation of brittle phases in certain temperature ranges it has a tendency to instability phenomena which impair the mechanical properties.

DESCRIPTION OF THE INVENTION

The invention is based on the object of providing a superalloy with oxide dispersion hardening which is based on nickel and which, while retaining the highest possible high-temperature strength, in particular the creep limit, has an increased resistance to sulfidation with the formation of brittle phases being avoided. The alloy is intended to have long-term stability and not to undergo any change in the course of prolonged service life.

This object is achieved by the nickel-based superalloy mentioned in the introduction wherein the composition is as follows:

Cr=17.0% by weight,
Al=6.0% by weight,
Mo=2.0% by weight,
W=3.5% by weight,
Ta=2.0% by weight,
Zr=0.15% by weight,
B=0.01% by weight,
C=0.05% by weight,
$Y_2O_3$=1.1% by weight,
Ni=Remainder.

METHOD OF IMPLEMENTING THE INVENTION

The invention is explained on the basis of the exemplary embodiments below.

EXEMPLARY EMBODIMENT I

An alloy with the following composition was prepared:

Cr=17.0% by weight,
AL=6.0% by weight,
Mo=2.0% by weight,
W=3.5% by weight,
Ta=2.0% by weight,
Zr=0.15% by weight,
B=0.01% by weight,
C=0.05% by weight,
$Y_2O_3$=1.1% by weight,
Ni=Remainder.

First of all a melt of the above composition but without $Y_2O_3$ added was prepared and converted into a powder by gas atomization using argon under high pressure. The powder was relatively coarse grained. Particles with a diameter of over 300 μm were retained by means of a sieve. Further use was made of the fractions underneath. The alloy powder was mixed with fine $Y_2O_3$ powder having a maximum particle diameter of 1 μm with a maximum crystallite diameter of 100 nm. Then the powder mixture was alloyed mechanically in an attritor for 36 h under an argon atmosphere. The attritor S-1, manufactured by Netzsch, Federal Republic of Germany, had a capacity of 3 liters and was filled with 12 kg of steel balls. The powder capacity was 1 kg.

The mechanically alloyed powder was then poured into a mild steel can with an outside diameter of 73 mm and a height of 75 mm. The whole was heated in vacuo to 300° C. and the can was sealed in an airtight manner by welding. The encapsulated powder was then pressed into a rod in an extrusion press at a temperature of 975° C. The rod had a diameter of approximately 19.5 mm (reduction ratio of extrusion press=14:1). The steel surface layer was removed by turning off so that the rod finally had a diameter of 18 mm. The rod was then subjected to a zone annealing process.

A temperature gradient which exceeded the value of 8° C./mm was employed to achieve longitudinally-oriented grains with a length to width ratio of more than 10.

The mechanical properties were investigated. In particular the creep rupture strength (creep limit) was measured for a period of $5\times10^4$ h at various temperatures. The values were:

| Temperature (°C.) | Creep rupture strength (MPa) |
|---|---|
| 800 | 215 |
| 900 | 158 |
| 1000 | 138 |

The oxidation and corrosion resistance was better than that of the known alloy having the trade name MA 6000.

Specimens with a smooth surface were subjected to a temperature cycle in air and the specific change in weight per unit area was determined after 1000 cycles. One cycle lasted approximately one hour: the specimen body was heated to a temperature of 1000° C. and left at this temperature for 1 h. Then it was cooled at a rate of 500° C./min and heated again, and so on. The change in weight is a measure of the oxidation resistance.

In the present case the change in weight was +0.5 mg/cm$^2$ of surface.

The comparative figure for the alloy MA 6000 was −10.5 mg/cm$^2$.

EXEMPLARY EMBODIMENT II

An alloy of the following composition was prepared.
Cr=17.0% by weight,
Al=6.0% by weight,
Mo=2.0% by weight,
W=3.5% by weight,
Ta=2.0% by weight,
Hf=1.0% by weight,
Zr=0.15% by weight,
B=0.01% by weight,
C=0.05% by weight,
$Y_2O_3$=1.1% by weight,
Ni=Remainder.

The powder was produced and processed further as in the process steps specified in Example I.

The creep rupture strength (creep limit) measured on the specimens for a period of $5\times10^4$ h was, as a function of temperature:

| Temperature (°C.) | Creep rupture strength (MPa) |
|---|---|
| 800 | 221 |
| 900 | 165 |
| 1000 | 140 |

The resistance to oxidation was determined by the change in weight as defined in Example I and was +0.5 mg/cm$^2$ of surface.

EXEMPLARY EMBODIMENT III

An alloy of the following composition was prepared:
Cr=17.0% by weight,
Al=6.0% by weight,
Co=10.0% by weight,
Ta=5.0% by weight,
Zr=0.15% by weight,
B=0.01% by weight,
C=0.05% by weight,
$Y_2O_3$=1.1% by weight,
Ni=Remainder.

The powder was produced and processed further as in the process steps specified under Example I.

The creep rupture strength (creep limit) measured on the specimens for a period of $5\times10^4$ h was, as a function of temperature:

| Temperature (°C.) | Creep rupture strength (MPa) |
|---|---|
| 800 | 205 |
| 900 | 145 |
| 1000 | 115 |

The oxidation resistance was determined by the change in weight as defined in Example I and was +0.4 mg/cm$^2$ of surface.

The invention is not limited to the exemplary embodiments. Preferably, the alloys may lie within the scope of the following composition limits:
Cr=17–18% by weight,
Al=6–7% by weight,
Mo=2–2.5% by weight,
W=3–3.5% by weight,
Ta=2–2.5% by weight,
Zr<0.2% by weight,
B<0.02% by weight,
C<0.1% by weight,
$Y_2O_3$=1–1.5% by weight,
Ni=Remainder.

A further advantageous group with hafnium added has the following composition:
Cr=17–18% by weight,
Al=6–7% by weight,
Mo=2–2.5% by weight,
W=3–3.5% by weight,
Ta=2–2.5% by weight,
Hf=0.5–1.5% by weight,
Zr<0.2% by weight,
B<0.02% by weight,
C<0.1% by weight,
$Y_2O_3$=1–1.5% by weight,
Ni=Remainder.

The hafnium improves the lateral strength in particular.

The alloys may also contain cobalt as an alloying element in accordance with the following description:
Cr=16–18% by weight,
Al=6–7% by weight,
Co=8–10% by weight,
Ta=5–7% by weight,
Zr<0.2% by weight,
B<0.02% by weight,
C<0.1% by weight,
$Y_2O_3$=1–1.5% by weight, Ni=Remainder.

Cobalt increases the strength and improves the workability.

In particular, the following composition also proves to be advantageous:

Cr=17.0% by weight,
Al=6.0% by weight,
Co=8.0% by weight,
Ta=6.5% by weight,
Zr=0.15% by weight,
B=0.01% by weight,
C=0.05% by weight,
$Y_2O_3$=1.1% by weight,
Ni=Remainder.

We claim:

1. A superalloy with oxide dispersion hardening having improved corrosion resistance and based on nickel, which consists essentially of:

Cr=17-18% by weight,
Al=6-7% by weight,
Mo=2-2.5% by weight,
W=3-3.5% by weight,
Ta=2-2.5% by weight,
Zr<0.2% by weight,
B<0.02% by weight,
C<0.1% by weight,
$Y_2O_3$=1-1.5% by weight,
Ni=remainder.

2. A superalloy with oxide dispersion hardening having improved corrosion resistance and based on nickel, which consists essentially of:

Cr=17.0% by weight,
Al=6.0% by weight,
Mo=2.0% by weight,
W=3.5% by weight,
Ta=2.0% by weight,
Zr=0.15% by weight,
B=0.01% by weight,
C=0.05% by weight,
$Y_2O_3$=1.1% by weight,
Ni=remainder.

3. A superalloy with oxide dispersion hardening having improved corrosion resistance and based on nickel, which consists essentially of:

Cr=17-18% by weight,
Al=6-7% by weight,
Mo=2-2.5% by weight,
W=3-3.5% by weight,
Ta=2-2.5% by weight,
Hf=0.5-1.5% by weight,
Zr<0.2% by weight,
B<0.02% by weight,
C<0.1% by weight,
$Y_2O_3$=1-1.5% by weight,
Ni=remainder.

4. A superalloy with oxide dispersion hardening having improved corrosion resistance and based on nickel, which consists essentially of:

Cr=17.0% by weight,
Al=6.0% by weight,
Mo=2.0% by weight,
W=3.5% by weight,
Ta=2.0% by weight,
Hr=1.0% by weight,
Zr=0.15% by weight,
B=0.01% by weight,
C=0.05% by weight,
$Y_2O_3$=1.1% by weight,
Ni=remainder.

5. A superalloy with oxide dispersion hardening having improved corrosion resistance and based on nickel, which consists essentially of:

Cr=16-18% by weight,
Al=6-7% by weight,
Co=8-10% by weight,
Ta=5-7% by weight,
Zr<0.2% by weight,
B<0.02% by weight,
C<0.1% by weight,
$Y_2O_3$=1-1.5% by weight,
Ni=remainder.

6. A superalloy with oxide dispersion hardening having improved corrosion resistance and based on nickel, which consists essentially of:

Cr=17.0% by weight,
Al=6.0% by weight,
Co=10.0% by weight,
Ta=5.0% by weight,
Zr=0.15% by weight,
B=0.01% by weight,
C=0.05% by weight,
$Y_2O_3$=1.1 by weight,
Ni=remainder.

7. A superalloy with oxide dispersion hardening having improved corrosion resistance and based on nickel, which consists essentially of:

Cr=17.0% by weight,
Al=6.0% by weight,
Co=8.05 by weight,
Ta=6.5% by weight,
Zr=0.15% by weight,
B=0.01% by weight,
C=0.05% by weight,
$Y_2O_3$=1.1% by weight,
Ni=remainder.

* * * * *